US007876273B2

(12) United States Patent
Breiter et al.

(10) Patent No.: US 7,876,273 B2
(45) Date of Patent: Jan. 25, 2011

(54) APPARATUS AND METHOD

(75) Inventors: Richard Breiter, Frederiksberg C (DK); Jens Troelsen, Copenhagen NV (DK); Alexandre Pinto, Kobenhav NV (DK); Bjarne Nielsen, Copenhagen NV (DK)

(73) Assignee: Nokia Corporation, Espoo (FI)

( * ) Notice: Subject to any disclaimer, the term of this patent is extended or adjusted under 35 U.S.C. 154(b) by 423 days.

(21) Appl. No.: 12/004,744

(22) Filed: Dec. 21, 2007

(65) Prior Publication Data

US 2009/0160712 A1 Jun. 25, 2009

(51) Int. Cl.
*H01Q 1/24* (2006.01)

(52) U.S. Cl. ..... 343/702

(58) Field of Classification Search ..... 343/702, 343/700 MS, 895

See application file for complete search history.

(56) References Cited

U.S. PATENT DOCUMENTS

| | | | | |
|---|---|---|---|---|
| 6,011,524 | A * | 1/2000 | Jervis | 343/895 |
| 6,646,610 | B2 | 11/2003 | Troelsen | 343/702 |
| 6,734,825 | B1 | 5/2004 | Guo et al. | 343/700 MS |
| 6,937,196 | B2 | 8/2005 | Korva | 343/702 |
| 7,187,959 | B2 * | 3/2007 | Ponce De Leon et al. | 455/575.7 |
| 7,242,364 | B2 | 7/2007 | Ranta | 343/860 |
| 2004/0145527 | A1 | 7/2004 | Mikkola | 343/700 MS |
| 2004/0147297 | A1 | 7/2004 | Mikkola et al. | 455/575.7 |
| 2005/0113037 | A1 * | 5/2005 | Ponce De Leon et al. | 455/90.3 |
| 2006/0135090 | A1 | 6/2006 | Annamaa | 455/95 |
| 2006/0208951 | A1 | 9/2006 | Korva et al. | 343/702 |
| 2007/0120740 | A1 | 5/2007 | Iellici et al. | 343/700 MS |
| 2008/0088511 | A1 * | 4/2008 | Sorvala et al. | 343/700 MS |
| 2008/0252536 | A1 * | 10/2008 | Anguera et al. | 343/702 |

FOREIGN PATENT DOCUMENTS

| | | | |
|---|---|---|---|
| EP | 1 075 043 | A1 | 2/2001 |
| EP | 1 439 601 | A1 | 7/2004 |
| EP | 1 439 604 | A1 | 7/2004 |
| EP | 1544943 | A1 | 6/2005 |
| WO | WO-2004-070875 | A1 | 8/2004 |
| WO | WO-2005/034286 | A1 | 4/2005 |
| WO | WO-2006-070233 | A1 | 7/2006 |
| WO | WO 2007/040431 | A1 | 4/2007 |

OTHER PUBLICATIONS

Pertti Vainikainen et al., "Resonator-Based Analysis of the Combination of Mobile Handset Antenna and Chassis", IEEE Transactions On Antennas And Propagation, vol. 50, No. 10, Oct. 2002, pp. 1433-1443, 7486279.

(Continued)

*Primary Examiner*—Huedung Mancuso
(74) *Attorney, Agent, or Firm*—Harrington & Smith

(57) ABSTRACT

An apparatus including a first conductive cover portion defining an interior surface and an exterior surface of the apparatus; an antenna element, connected to a feed point and arranged to operate in at least a first resonant frequency band; a conductive element, positioned between the interior surface of the first conductive cover portion and the antenna element, and arranged to couple with the first conductive cover portion, wherein the combination of the conductive element and the first conductive cover portion are operable in a second resonant frequency band, different to the first resonant frequency band and are arranged to be contactlessly fed by the antenna element.

24 Claims, 3 Drawing Sheets

OTHER PUBLICATIONS

Suvi Tarvas et al., "An Internal Dual-Band Mobile Phone Antenna", IEEE 2000, pp. 266-269, 6805041.
Jani Ollikainen et al., "Internal Dual-Band Patch Antenna For Mobile Phones", 2000 European Space Agency, Reprinted with permission from Proceedings of the AP2000 Millennium Conference on Antennas & Propagation, Davos, Switzerland, Apr. 9-14, 2000.

* cited by examiner

APPARATUS AND METHOD

FIELD OF THE INVENTION

Embodiments of the present invention relate to apparatus and method. In particular, they related to an apparatus for wireless communications and a method for manufacturing the apparatus.

BACKGROUND TO THE INVENTION

Apparatus, such as portable communication devices (e.g. mobile cellular telephones) usually include a plastic cover which houses and protects the electronic components of the apparatus from damage (e.g. from atmospheric conditions such as rain or from being knocked by the user of the apparatus). Users usually prefer apparatus with an aesthetically pleasing cover and there is an increasing demand for apparatus which include metallic covers.

Metallic covers are electrically conductive and are sometimes contactlessly (electromagnetically) fed by an antenna element which is positioned within the apparatus to transmit and receive radio frequency signals. However, the operational resonant frequency band of the apparatus is then determined by the dimensions of the cover and this may constrain the design of the cover and the apparatus.

Therefore, it would be desirable to provide an alternative apparatus.

BRIEF DESCRIPTION OF VARIOUS EMBODIMENTS OF THE INVENTION

According to various embodiments of the invention there is provided an apparatus comprising: a first conductive cover portion defining an interior surface and an exterior surface of the apparatus; and antenna element, connected to a feed point and arranged to operate in at least a first resonant frequency band; a conductive element, positioned between the interior surface of the first conductive cover portion and the antenna element, and arranged to couple with the first conductive cover portion, wherein the combination of the conductive element and the first conductive cover portion are operable in a second resonant frequency band, different to the first resonant frequency band and are arranged to be contactlessly fed by the antenna element.

The apparatus may be for wireless communications.

The conductive element may be arranged to electromagnetically couple with the first conductive cover portion. Alternatively, the conductive element may be electrically connected to the first conductive cover portion.

The apparatus may further comprise a second conductive cover portion, positioned adjacent the first conductive cover portion and arranged to electromagnetically couple with the combination of the conductive element and the first conductive cover portion. The second conductive cover portion may be a cover for the apparatus or may be a cover for a component (e.g. a battery) within the apparatus.

The first conductive cover portion and the second conductive cover portion may define an aperture. The aperture may compromise any suitable insulative material.

It should be appreciated that the above mentioned aperture is not the same as an 'antenna aperture' as known in the art of antennas. The above mentioned aperture is a gap between the first conductive cover portion and the second conductive cover portion which may be filled with a suitable insulative material. In various embodiments of the present invention, the aperture may be slot shaped.

The apparatus may further comprise a support element defining an upper surface and a lower surface. The antenna element may be physically coupled to the lower surface of the support element and the conductive element may be physically coupled to the upper surface of the support element.

The antenna element may be plated on the lower surface of the support element and the conductive element may be plated on the upper surface of the support element. The support element may comprise dielectric material.

The support element may be a printed wiring board (PWB), a plated plastic moulding, or other plateable material, for example, moulded interconnect devices (MID).

The support element may also comprise a stack of layers, further comprising a lower conductive layer, an insulative dielectric layer, and an upper conductive layer. The conductive layers may comprise any known conductive materials, for example, copper, gold, silver, etc. The insulative layer may comprise any known non-conductive material which is low loss in the radio frequency domain, and more importantly is low loss in the frequency bands of interest for the apparatus.

The antenna element may be operable to transmit and receive signals in a first radio frequency protocol. The combination of the conductive element and the first conductive cover portion may be operable to transmit and receive signals in a second radio frequency protocol, different to the first radio frequency protocol.

The antenna element may be operable in a third resonant frequency band, different to the first and second resonant frequency bands.

According to various embodiment of the invention, there is provided a portable wireless device comprising an apparatus as described in any of the preceding paragraphs.

According to various embodiments of the invention there is provided a method comprising: providing a first conductive cover portion defining an interior surface and an exterior surface of the apparatus, and antenna element, connected to a feed point and arranged to operate in at least a first resonant frequency band, and a conductive element, positioning the conductive element between the interior surface of the first conductive cover portion and the antenna element so that the conductive element is configured to couple with the first conductive cover portion, the combination of the conductive element and the first conductive cover portion being operable in a second resonant frequency band, different to the first resonant frequency band; and arranging the combination of the conductive element and the first conductive cover portion to be contactlessly fed by the antenna element.

The method may further comprise arranging the conductive element for electromagnetically coupling with the first conductive cover portion. Alternatively, the method may further comprise electrically connecting the conductive element to the first conductive cover portion.

The method may further comprise providing a second conductive cover portion and positioning it adjacent the first conductive cover portion for electromagnetically coupling with the combination of the conductive element and the first conductive cover portion.

The method may further comprise positioning the first conductive cover portion and the second conductive cover portion to define an aperture, and selecting the size of the aperture to tune the combination of the first conductive cover portion and the conductive element. The aperture may comprise a dielectric material.

The method may further comprise providing a support element defining an upper surface and a lower surface, and physically coupling the antenna element to the lower surface of the support element and physically coupling the conductive element to the upper surface of the support element.

The method comprise plating the antenna element on the lower surface of the support element and plating the conductive element on the upper surface of the support element. The support element may comprise dielectric material.

The antenna element may be operable to transmit and receive signals in a first radio frequency protocol. The combination of the conductive element and the first conductive cover portion may be operable to transmit and receive signals in a second radio frequency protocol, different to the first radio frequency protocol.

The antenna element may be operable in a third resonant frequency band, different to the first and second resonant frequency bands.

According to various embodiments of the present invention, there is provided an apparatus comprising: a first conductive cover portion means defining an interior surface and an exterior surface of the apparatus; an antenna element means, connected to a feed point and arranged to operate in at least a first resonant frequency band; a conductive element means, positioned between the interior surface of the first conductive cover portion means and the antenna element means, and arranged to couple with the first conductive cover portion means, wherein the combination of the conductive element means and the first conductive cover portion means are operable in a second resonant frequency band, different to the first resonant frequency band and are arranged to be contactlessly fed by the antenna element means.

According to various embodiments of the present invention, there is provided a wireless device comprising a first conductive cover portion, and a second conductive cover portion substantially covering the rear surface of the wireless device, said first conductive cover portion and second conductive cover portion being galvanically isolated and separated by an aperture extending across the rear surface, said first conductive cover portion defining an interior surface and an exterior surface of the wireless device; an antenna element, connected to a feed point and arranged to operate in at least a first resonant frequency band; a conductive element, positioned between the interior surface of the first conductive cover portion and the antenna element, and arranged to couple with the first conductive cover portion, wherein the combination of the conductive element and the first conductive cover portion are operable in a second resonant frequency band, different to the first resonant frequency band and are arranged to be contactlessly fed by the antenna element.

BRIEF DESCRIPTION OF THE DRAWINGS

For a better understanding of various embodiments of the present invention reference will not be made by way of example only to the accompanying drawings in which.

DETAILED DESCRIPTION OF VARIOUS EMBODIMENTS OF THE INVENTION

Figure 1:
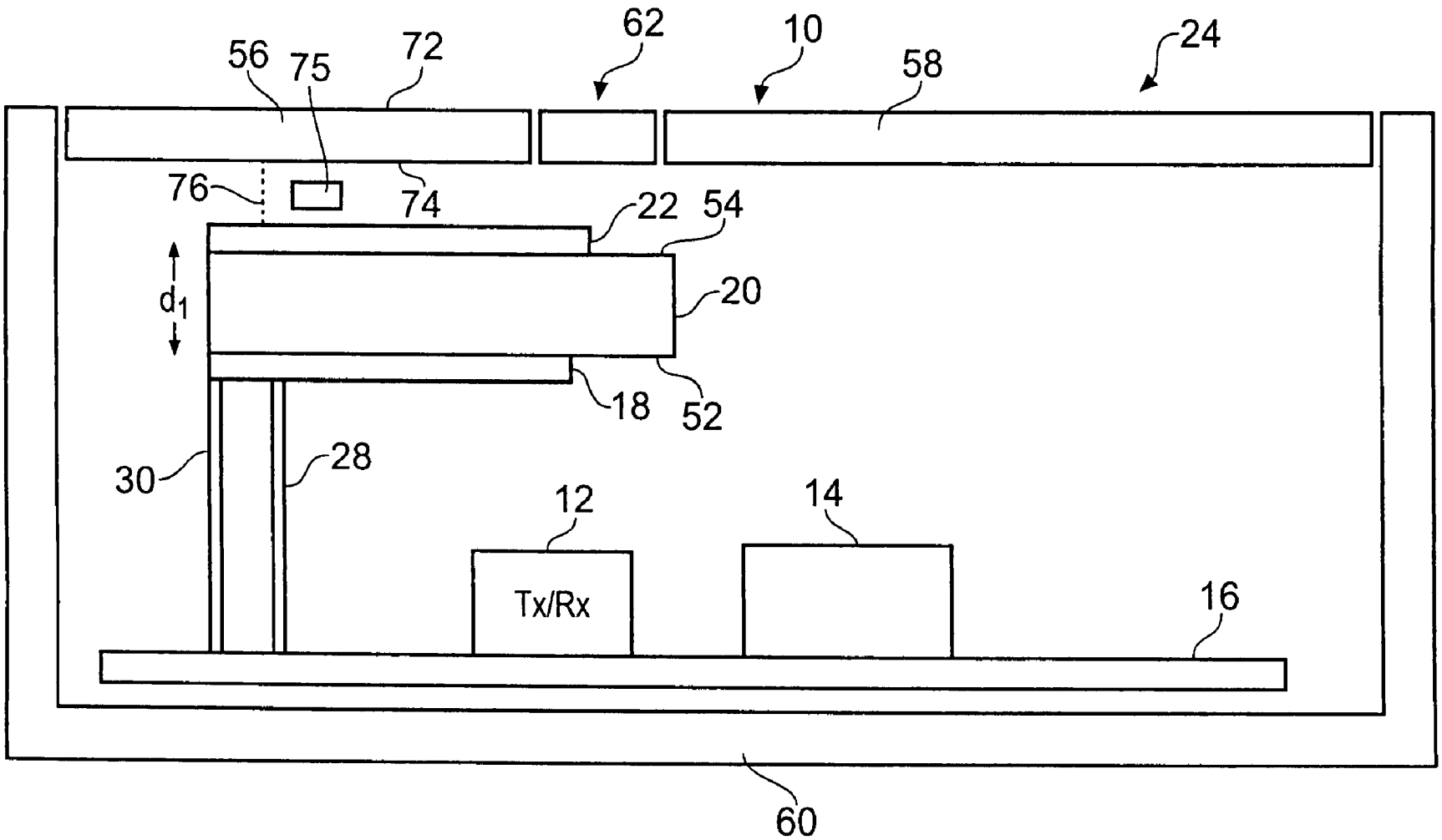
FIG. 1 illustrates a schematic cross sectional side view of an apparatus according to various embodiments of the present invention.

FIG. 1 illustrates an apparatus 10 comprising: a first conductive cover portion 56 defining an interior surface 74 and an exterior surface 72 of the apparatus 10; an antenna element 18, connected to a feed point 28 and arranged to operate in at least a first resonant frequency band; a conductive element 22, positioned between the interior surface 74 of the first conductive cover portion 56 and the antenna element 18, and arranged to couple with the first conductive cover portion 56, wherein the combination of the conductive element 22 and the first conductive cover portion 56 are operable in a second resonant frequency band, different to the first resonant frequency band and are arranged to be contactlessly fed by the antenna element 18.

In more detail, FIG. 1 illustrates a schematic cross sectional side view of an apparatus 10 according to various embodiments of the present invention. The apparatus 10 includes radio transceiver circuitry 12 and functional circuitry 14 mounted on a printed wiring board 16. The apparatus 10 also includes an antenna element 18, a support element 20, a conductive element 22 and a cover 24. The apparatus 10 may be any portable wireless device and may be, for example, a mobile cellular telephone, a personal digital assistant (PDA), a laptop computer, a portable WLAN or WiFi device, or module for such devices. In the embodiment where the apparatus 10 is a mobile cellular telephone, the functional circuitry 14 includes a processor, a memory, input/output devices such as a microphone, a loudspeaker, keypad and a display. The electronic components that provide the radio transceiver circuitry 12 and functional circuitry 14 are interconnected via the printed wiring board 16 which may server as a ground plane for the antenna element 18. In various embodiments, the printed wiring board 16 may be a flexible printed wiring board.

The antenna element 18 is coupled to the radio transceiver circuitry 12, which is in turn coupled to the functional circuitry 14. The coupling of the antenna element 18, the radio transceiver circuitry 12 and the functional circuitry 14 may be via a direct electrical connection (i.e. a galvanic connection) or via electromagnetic or capacitive coupling. The radio transceiver circuitry 12 is operable to receive and encode signals from the functional circuitry 14 and provide them to the antenna element 18 for transmission. The radio transceiver circuitry 12 is also operable to receive and decode signals from the antenna element 18 and then provide them to the functional circuitry 14 for processing.

The antenna element 18 may be any antenna which is suitable for operation in an apparatus such as a mobile cellular telephone. For example, the antenna element 18 may be a planar inverted F antenna (PIFA), a planar inverted L antenna (PILA), a loop antenna, a monopole antenna or a dipole antenna. The antenna element 18 is electrically connected to the radio transceiver circuitry 12 at a feed point 28 and may be connected to the ground plane 16 at a ground point 30. The antenna element 18 is operable in at least one resonant frequency band and may also be operable in a plurality of different radio frequency bands and/or protocols (e.g. GSM, CDMA, and WCDMA). In various embodiments, the antenna element 18 is operable in a first resonant frequency band and a third resonant frequency band, different to the first resonant frequency band.

Figure 2:
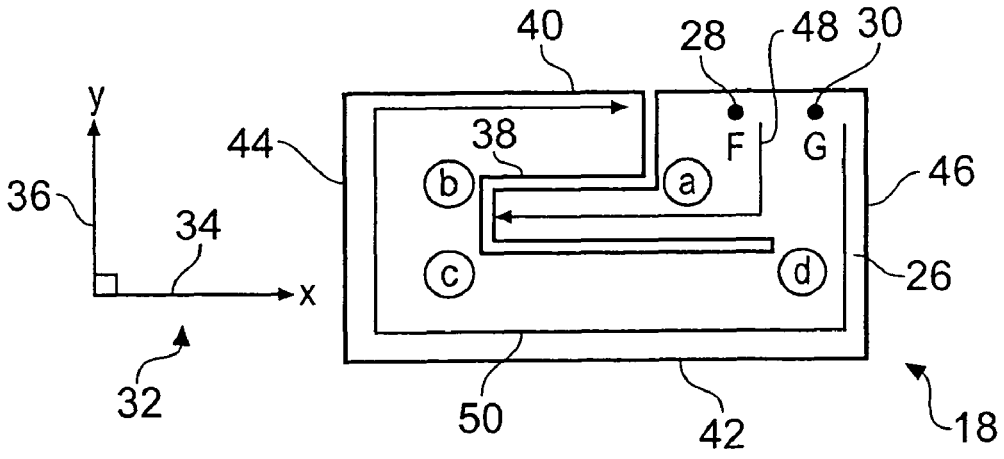
FIG. 2 illustrates a schematic plan view of an antenna element according to various embodiments of the present invention.

FIG. 2 illustrates a schematic plan view of one embodiment of an antenna element 18. It should be appreciated that the embodiment illustrated in FIG. 2 is an example and is provided to illustrate how an antenna element may be operable in more than one resonant frequency band.

In this embodiment the antenna element 18 is a planar inverted F antenna which includes a substantially planar antenna track 26, a feed point 28 and a ground point 30. In other embodiments, the antenna track 26 may have a curved and shaped profile which corresponds to the curvature and shape of the apparatus cover 24. FIG. 2 also illustrates a Cartesian coordinate system 32 which includes an X axis 34 and a Y axis 36 which are orthogonal to one another.

The antenna track 26 is substantially rectangular and has a top edge 40, a bottom edge 42, a left edge 44 and a right edge 46. The distance between the left edge 44 and the right edge 46 is greater than the distance between the top edge 40 and the bottom edge 42. The antenna track 26 defines a slot 38 which extends from the middle of the top edge 40 of the antenna track 26 in the −Y direction until a point (a). The slot 38 then makes a right angled right handed turn and extends in the −X direction until a point (b). The slot 38 then makes a right angled left handed turn and extends in the −Y direction until point (c). The slot 38 then makes a right angled left handed turn and extends in the +X direction until it's end point (d).

When the antenna element 18 is electrically fed by the radio transceiver circuitry 12, a first current path 48 extends from the feed point 28 to the slot 38 between points (b) and (c). The first current path 48 causes the antenna element 18 to be operable in a first resonant frequency band. Additionally, when the antenna element 18 is electrically fed by the radio transceiver circuitry 12, a second current path 50 extends from the feed point 28, round the slot 38 (i.e. passed points (d), (c) and (b)) to between where the slot 38 extends from the top edge 40 of the antenna track 26 and point (a). The second current path 50 causes the antenna element 18 to be operable in a third resonant frequency band, different to the first resonant frequency band.

Returning to FIG. 1, the antenna element 18 is physically coupled to a lower surface 52 of the support element 20. The physical coupling may be any suitable type of coupling and may be one of the following plating techniques; laser direct structuring (LDS), two shot molded interconnect devices (MID), physical vapor deposition (PVD) or conductive ink. These techniques are well known in the art of plating and will consequently not be discussed in detail here. The support element 20 comprises dielectric material and has a depth d1.

The conductive element 22 is physically coupled to the upper surface 54 of the support element 20 and may be coupled via any of the plating techniques mentioned in the previous paragraph. The selection of the dimensions of the conductive element 22 will be discussed in the following paragraphs.

Embodiments of the present invention provide an advantage in that the distance between the antenna element 18 and the conductive element 22 can be relatively easily controlled by selecting the depth d1 of the support element 20. Since the positioning of the conductive element 20 affects the tuning of the antenna element 18 (the antenna element 18 electromagnetically couples to the conductive element 22), embodiments of the present invention may facilitate the tuning of the antenna element 18. For example, if the depth d1 is decreased, the antenna element 18 electromagnetically couples more strongly with the conductive element 22 which results in the electrical length of the antenna element 18 increasing and the resonant frequencies of the antenna element 18 decreasing. The cover 24 houses the electronic components of the apparatus 10 (e.g. the functional circuitry 14) and helps to protect them from damage (e.g. atmospheric conditions such as rain, accidental impacts from the user etc). The cover 24 defines the exterior surface of the apparatus 10 which is visible to the user and may include a plurality of separable portions.

In this embodiment, the cover 24 includes a first conductive cover portion 56, a second conductive cover portion 58 and a third cover portion 60. The first, second and third cover portions 56, 58, 60 define an aperture 62 which may comprise an insulative material. In other embodiments, the cover 24 may be a single element and only comprise the first conductive cover portion 56 which defines the aperture 62.

As mentioned above, it should be appreciated that the above mentioned aperture 62 is not the same as an 'antenna aperture' as known in the art of antennas. The above mentioned aperture 62 is a gap between the first conductive cover portion 56, the second conductive cover portion 58 and the third cover portion 60 which may be filled with a suitable insulative material. In various embodiments of the present invention, the aperture 62 may be slot shaped.

The first conductive cover portion 56 and or second conductive cover portion 58 may be comprised of stainless steel, or other aesthetically pleasing hard wearing metals.

Figure 3A:
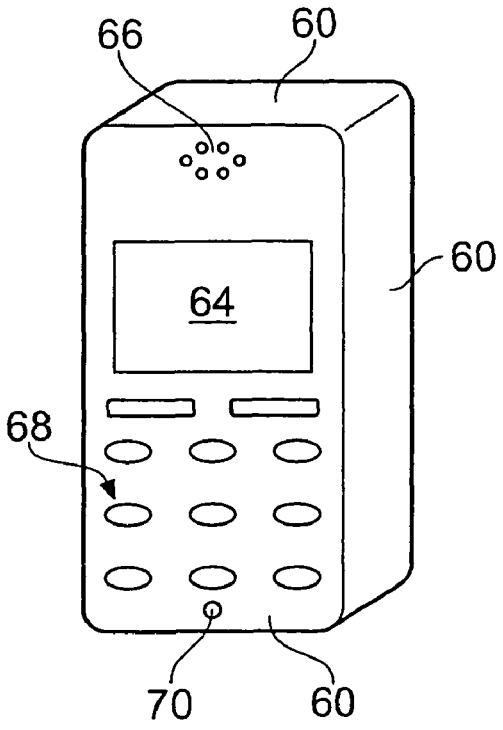
FIG. 3A illustrates a front view of a mobile cellular telephone according to various embodiments of the present invention.
Figure 3B:
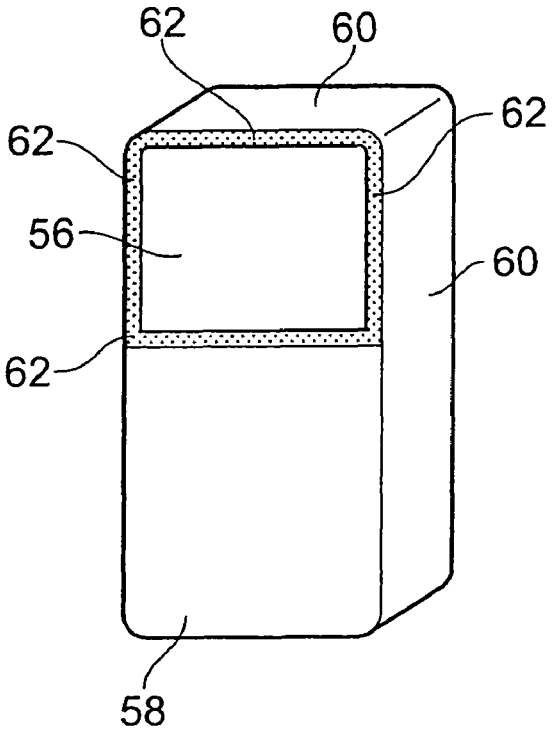
FIG. 3B illustrates a rear view of a mobile cellular telephone according to various embodiments of the present invention.

FIGS. 3A and 3B illustrates front and rear views of one embodiment of a mobile cellular telephone 10. As can be viewed in FIG. 3A, the third cover portion 60 provides the exterior surface of the front sides of the apparatus 10. The third cover portion 60 may include apertures for a display 64, a loudspeaker 66, a keypad 68 and a microphone 70. The third cover portion 60 may comprise metal and be conductive or it may be plastic and be non-conductive.

As can be viewed in FIG. 3B, the first conductive cover portion 56 and the second conductive cover portion 58 provide the exterior surface of the rear of the mobile cellular telephone 10. It should be appreciated that the wording 'front', 'rear' and 'sides' are with respect to the position in which the user operates the mobile cellular telephone (e.g. the display 64 is provided on the 'front' of the mobile celluar telephone). The first and second conductive cover portions 56, 58 comprise metal and are electrically conductive.

It should be appreciated that the first conductive cover portion 56 may have any shape and dimensions. For example, the first conductive cover portion 56 may extend at least partially over the sides and front of the mobile cellular telephone 10.

Returning to FIG. 1, the first conductive cover portion 56 defines an exterior surface 72 and an interior surface 74 of the apparatus 10. The conductive element 22 is positioned between the antenna element 18 and the interior surface 74 of the first conductive cover portion 56 so that it can, in some embodiments, electromagnetically couple with the first conductive cover portion 56. In various embodiments, the conductive element 22 is electrically connected to the first conductive cover portion 56 via galvanic connection (indicated by dotted line with reference numeral 76). In other embodiments the conductive element 22 is configured to contactlessly (i.e. electromagnetically) couple with the first conductive cover portion 56. The conductive element 22 and the first conductive cover portion 56 are not electrically connected to the ground plane 16.

From the above paragraph, it should be appreciated that the shape and dimensions of the conductive element 22 are selected to obtain a desired electrical length (and hence resonant frequency and) for the combination of the first conductive cover portion 56 and the conductive element 22. In various embodiments, the conductive element 22 may be shaped so that it snugly fits adjacent the interior surface 74 of the first conductive cover portion 56. Consequently, the conductive element 22 may be curved in order to match the curvature of the first conductive cover portion 56. It should also be appreciated that as a consequence of this, that the antenna element 18 would also follow the curvature of the conductive element 22 and the first conductive cover portion 56. Such an arrangement may reduce the volume required for conductive element 22 and may increase the electromagnetic coupling between the conducting element 22 and the first conductive cover portion 56.

The conductive element 22 and the first conductive cover portion 56 are configured to couple together closely so that they appear as a single element to a radio frequency signal. The combination of the conductive element 22 and the first conductive cover portion 56 is thereby configured to operate in a second resonant frequency band, different to the first and third resonant frequency bands. It should be appreciated that the second resonant frequency band is determined by the combined electrical lengths of the first conductive cover portion 56 and the conductive element 22.

In operation, the combination of the conductive element 22 and the first conductive cover portion 56 is configured to be contactlessly fed (i.e. electromagnetically) by the antenna element 18. For example, if the antenna element 18 is the same as that illustrated in FIG. 2, the combination is configured to be contactlessly fed by an RF signal from the antenna element 18 in either the first resonant frequency band or the second resonant frequency band.

The combined electrical lengths of the conductive element 22 and the first conductive cover portion 56 are selected to enable electromagnetic coupling between the combination and the antenna element 18. The electrical length of the combination of the conductive element 22 and the first conductive cover portion 56 may be adjusted by changing the dimensions of the conductive element 22 and/or the first conductive cover portion 56. However, since the conductive element 22 is not visible to the user (as it is obscured by the first conductive cover portion 56 and may also be obscured by the aperture 62 filled with the insulation material), it may be preferable to only alter the dimensions of the conductive element 22. The electrical length of the combination of the conductive element 22 and the first conductive cover portion 56 can also be adjusted by changing the distance between them. For example, if the distance between the conductive element 22 and the first conductive cover portion 56 is reduced, the combination electromagnetically couple more strongly and the electrical length of the combination is increased. In various embodiments, the conductive element 22 and the first conductive cover portion 56 may be positioned as close to one another as possible.

It should be appreciated that the conductive element 22 may at least partially overlap the aperture 62 to enable coupling to the second conductive cover portion 58. This may allow further adjustment of the second resonant frequency band, as formed from the combination of the first conductive cover portion 56 and the conductive element 22.

It should also be appreciated that although the resonant frequency bands of the combination 22, 56 and the antenna element 18 are different to one another, the resonant frequency band of the combination 22, 56 should at least partially overlap with the resonant frequency band of the antenna element 18 in order to produce a resonance in the combination of the conductive element 22 and the first conductive cover portion 56. For example, in the embodiment where the antenna element 18 is similar to that illustrated in FIG. 2, the first resonant frequency band may be PCN/DCS1800 (1710-1880 MHz), the second resonant frequency band may be US-WCDMA1900 (1850-1990) and the third frequency band may be US-GSM 850 (824-894 MHz). In this example, RF signals in the first resonant frequency band of the antenna element 18 contactlessly feed the combination of the conductive element 22 and the first conductive cover portion 56 and cause them to resonate at the second resonant frequency band (since they partially overlap).

In the embodiment where the antenna element 18 is a PIFA and has an electrical length L1, the antenna element 18 resonates at L1=λ/4. The combination of the conductive element 22 and the first conductive cover portion 56 have an electrical length L2 and resonate at L2=λ/2. Assuming that the resonant frequency band of the combination 22, 56 is similar to the resonant frequency band of the antenna element 18, for the combination to be contactlessly fed by the antenna element 18, the combination should have an electrical length L2 that is twice the electrical length L1 of the antenna element 18.

The antenna element 18 and the combination of the first conductive cover portion 56 and the conductive element 22 may be arranged to operate in a plurality of different operational radio frequency bands and via a plurality of different protocols. For example, the different frequency bands and protocols may include (but are not limited to) DVB-H 470 to 750 MHz, US-GSM 850 (824-894 MHz); EGSM 900 (880-960 MHz); GPS 1572.42 MHz, PCN/DCS1800 (1710-1880 MHz); US-WCDMA1900 (1850-1990) band; WCDMA21000 band (Tx: 1920-1980I Rx: 2110-2180); PCS1900 (1850-1990 MHz); 2.5 GHz WLAN/BT, 5 GHz WLAN, DRM (0.15-30.0 MHz) FM (76-108 MHz), AM (0.535-1.705 MHz), DVB-H [US] (1670-1675 MHz), WiMax (2300-2400 MHz, 2305-2360 MHz, 2496-2690 MHz, 3300-3400 MHz, 3400-3800 MHz, 5150-5875 MHz), RFID (LF [125-134 kHz], HF[13.56 MHz]) UHF [433 MHz, 865-956 MHz or 2.45 GHz), and UWB 3.0 to 10.6 GHz.

Embodiments of the present invention provide an advantage in that by providing the conductive element 22 to couple with the first conductive cover portion 56, the resonant frequency of the first conductive cover portion 56 is no longer substantially determined by the dimensions of the first conductive cover portion 56. This may provide greater design freedom for the first conductive cover portion 56 because changes in its dimensions and hence resonant frequency can be compensated by the conductive element 22 which is not visible to the user.

Usually, the first conductive cover portion 56 is not designed by an antenna engineer but by an industrial or graphic designer for the apparatus 10. Embodiments of the present invention provide an advantage because it provides freedom of design for the industrial designer and allows him/her to design an almost fully metallised apparatus. It also provides an advantage for the antenna designer because it allows him/her to tune the first conductive cover portion 56 to the required frequency bands without having to alter the shape or dimensions of the first conductive cover portion 56.

In various embodiments of the invention, a buffer element 75 is provided between the first conductive cover portion 56 and the conductive element 22 to absorb impacts to the exterior of the apparatus 10 and prevent them from damaging the conductive element 22, support 20 and antenna element 18 stack. The buffer element 75 may comprise any suitable resilient material and may comprise, for example, rubber.

The second conductive cover portion 58 may be a portion of the cover 24 and define an exterior surface of the apparatus 10 (as illustrated in FIG. 1). In other embodiments, the second conductive cover portion 58 may be a cover for an electronic component within the apparatus (for example, it may be a metallic cover for the battery of the apparatus 10). The second conductive cover portion 58 comprises metal, is electrically conductive and may or may not be connected to the ground plane 16.

The second conductive cover portion 58 is configured to electromagnetically couple with the combination of the first conductive cover portion 56 and the conductive element 22 and thereby change the electrical length (and hence resonant frequency band) of the combination of the first conductive cover portion 56 and the conductive element 22. For example, if the distance between the combination of the first conductive cover portion 56 and the conductive element 22, and the second conductive cover portion 58 is decreased, the electromagnetic coupling strengthens between them and increases the electrical length of the combination and thereby reduces the resonant frequency of the combination. In order to not alter the appearance of the exterior of the apparatus 10, the conductive element 22 may be moved closer to, or away from the second conductive cover portion 58 in order to strengthen or weaken the electromagnetic coupling as desired.

Various embodiments of the present invention provide a wireless device comprising a first conductive cover portion 56, and a second conductive cover portion 58 substantially covering the rear surface of the wireless device, said first conductive cover portion 56 and second conductive cover portion 58 being galvanically isolated (i.e. not directly electrically connected to one another) and separated by an aperture extending across the rear surface. Said first conductive cover portion 56 defining an interior surface and an exterior surface of the wireless device; an antenna element, connected to a feed point surface of the wireless device; and antenna element, connected to a feed point and arranged to operate in at least a first resonant frequency band; a conductive element, positioned between the interior surface of the first conductive cover portion and the antenna element, and arranged to couple with the first conductive cover portion, wherein the combination of the conductive element and the first conductive cover portion are operable in a second resonant frequency band, different to the first resonant frequency band and are arranged to be contactlessly fed by the antenna element.

Embodiments of the present invention provide an advantage in that the second conductive cover portion 58 may be used to further lower the resonant frequency of the combination of the conductive element 22 and the first conductive cover portion 56. This may be particularly advantageous when there is insufficient space in the apparatus 10 to provide the combination of the conductive element 22 and the first conductive cover portion 56 with a desired electrical length.

Figure 4:
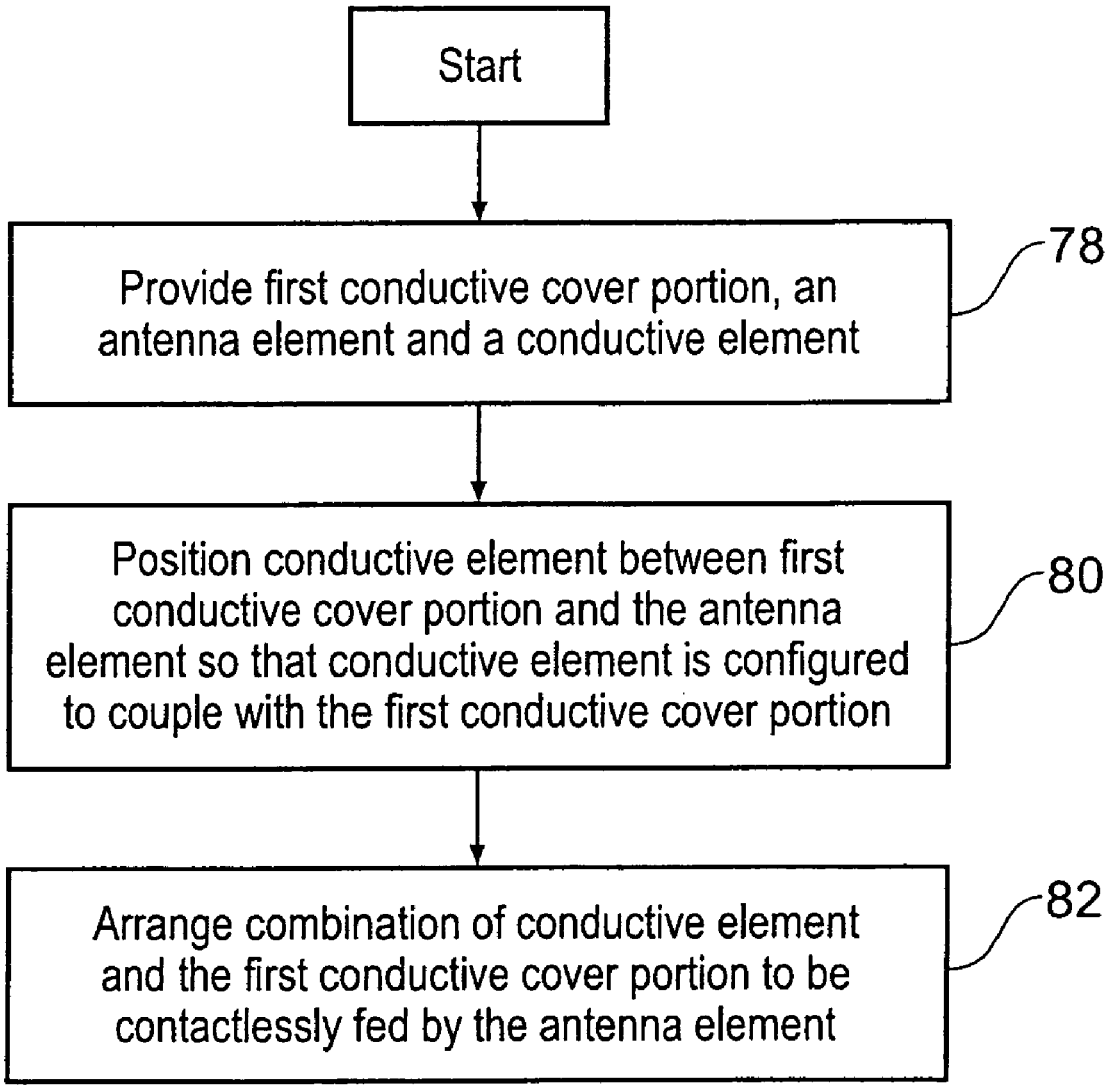
FIG. 4 illustrates a flow diagram which shows the main blocks for manufacturing an apparatus according to various embodiments of the present invention.

FIG. 4 illustrates a flow chart which shows some of the blocks for manufacturing an apparatus 10 to various embodiments of the present invention. The illustration of a particular order to the blocks does not necessarily imply that there is a required or preferred order for the blocks and the order and arrangement of the block may be varied.

At block 78, the method includes providing the first conductive cover portion 56, the antenna element 18 and a conductive element 22. At block 80, the conductive element 22 is positioned between the interior surface 74 of the first conductive cover portion 56 and the antenna element 18 so that the conductive element 22 is configured to couple with the first conductive cover portion 56. At block 82, the combination of the conductive element 22 and the first conductive cover portion 56 is arranged to be contactlessly fed by the antenna element.

Although embodiments of the present invention have been described in the preceding paragraphs with reference to various examples, it should be appreciated that modification to the examples given can be made without departing from the scope of the invention as claimed.

Features described in the preceding description may be used in combinations other than the combinations explicitly described.

Whilst endeavoring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

We claim:

1. An apparatus comprising:

a cover defining an exterior surface of the apparatus and including a first conductive cover portion;

an antenna element, connected to a feed point and configured to operate in at least a first resonant frequency band;

a conductive element, positioned between the first conductive cover portion and the antenna element, and configured to couple with the first conductive cover portion, wherein the combination of the conductive element and the first conductive cover portion are operable in a second resonant frequency band, different to the first resonant frequency band and are configured to be contactlessly fed by the antenna element.

2. An apparatus as claimed in claim 1, wherein the conductive element is configured to electromagnetically couple with the first conductive cover portion.

3. An apparatus as claimed in claim 1, wherein the conductive element is electrically connected to the first conductive cover portion.

4. An apparatus as claimed in claim 1, further comprising a second conductive cover portion, positioned adjacent the first conductive cover portion and configured to electromagnetically couple with the combination of the conductive element and the first conductive cover portion.

5. An apparatus as claimed in claim 4, wherein the first conductive cover portion and the second conductive cover portion define an aperture.

6. An apparatus as claimed in claim 5, wherein the aperture comprises dielectric material.

7. An apparatus as claimed in claim 1, further comprising a support element defining an upper surface and a lower surface, the antenna element being physically coupled to the lower surface of the support element and the conductive element being physically coupled to the upper surface of the support element.

8. An apparatus as claimed in claim 7, wherein the antenna element is plated on the lower surface of the support element and the conductive element is plated on the upper surface of the support element.

9. An apparatus as claimed in claim 8, wherein the support element comprises dielectric material.

10. An apparatus as claimed in claim 1, wherein the antenna element is configured to transmit and receive signals in a first radio frequency protocol and the combination of the conductive element and the first conductive cover portion is configured to transmit and receive signals in a second radio frequency protocol, different to the first radio frequency protocol.

11. An apparatus as claimed in claim 1, wherein the antenna element is operable in a third resonant frequency band, different to the first and second resonant frequency bands.

12. A portable wireless device comprising an apparatus as claimed in claim 1.

13. A method comprising:

providing a cover defining an exterior surface of the apparatus and including a first conductive cover portion, an antenna element, connected to a feed point and configured to operate in at least a first resonant frequency band, and a conductive element, positioning the conductive element between the first conductive cover portion and the antenna element so that the conductive element is configured to couple with the first conductive cover portion, the combination of the conductive element and the first conductive cover portion being operable in a second resonant frequency band, different to the first resonant frequency band; and configuring the combination of the conductive element and the first conductive cover portion to be contactlessly fed by the antenna element.

14. A method as claimed in claim 13, comprising configuring the conductive element to electromagnetically couple with the first conductive cover portion.

15. A method as claimed in claim 13, comprising electrically connecting the conductive element to the first conductive cover portion.

16. A method as claimed in claim 13, further comprising providing a second conductive cover portion and positioning it adjacent the first conductive cover portion for electromagnetically coupling with the combination of the conductive element and the first conductive cover portion.

17. A method as claimed in claim 16, comprising positioning the first conductive cover portion and the second conductive cover portion to define an aperture and selecting the size of the aperture to tune the combination of the first conductive cover portion and the conductive element.

18. A method as claimed in claim 17, wherein the aperture comprises a dielectric material.

19. A method as claimed in claim 13, further comprising providing a support element defining an upper surface and a lower surface, and physically coupling the antenna element to the lower surface of the support element and physically coupling the conductive element to the upper surface of the support element.

20. A method as claimed in claim 19, comprising plating the antenna element on the lower surface of the support element and plating the conductive element on the upper surface of the support element.

21. A method as claimed in claim 20, wherein the support element comprises dielectric material.

22. A method as claimed in claim 13, wherein the antenna element is configured to transmit and receive signals in a first radio frequency protocol and the combination of the conductive element and the first conductive cover portion is configured to transmit and receive signals in a second radio frequency protocol, different to the first radio frequency protocol.

23. A method as claimed in claim 13, wherein the antenna element is operable in a third resonant frequency band, different to the first and second resonant frequency bands.

24. An apparatus comprising:

a cover defining an exterior surface of the apparatus and including a first conductive cover portion means;

an antenna element means, connected to a feed point and configured to operate in at least a first resonant frequency band;

a conductive element means, positioned between the first conductive cover portion means and the antenna element means, and configured to couple with the first conductive cover portion means, wherein the combination of the conductive element means and the first conductive cover portion means are operable in a second resonant frequency band, different to the first resonant frequency band and are configured to be contactlessly fed by the antenna element means.

* * * * *